US009516987B2

(12) United States Patent
Rosenbauer et al.

(10) Patent No.: US 9,516,987 B2
(45) Date of Patent: Dec. 13, 2016

(54) LIGHTING DEVICE FOR A WATER-BEARING DOMESTIC APPLIANCE

(75) Inventors: Michael Rosenbauer, Reimlingen (DE); Bernd Schessl, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 13/477,098

(22) Filed: May 22, 2012

(65) Prior Publication Data

US 2012/0227773 A1 Sep. 13, 2012

Related U.S. Application Data

(63) Continuation of application No. 11/665,575, filed as application No. PCT/EP2005/055216 on Oct. 13, 2005, now abandoned.

(30) Foreign Application Priority Data

Oct. 20, 2004 (DE) ..... 10 2004 051 174

(51) Int. Cl.
*A47L 15/42* (2006.01)
*D06F 39/00* (2006.01)

(52) U.S. Cl.
CPC ..... *A47L 15/4257* (2013.01); *A47L 15/4246* (2013.01); *D06F 39/00* (2013.01); *A47L 15/4293* (2013.01)

(58) Field of Classification Search
None
See application file for complete search history.

(56) References Cited

U.S. PATENT DOCUMENTS

| | | | | |
|---|---|---|---|---|
| 2,656,451 | A | 10/1953 | Rick | |
| 3,268,283 | A * | 8/1966 | Ullman, Jr. | A47L 15/4251 312/263 |
| 3,619,592 | A * | 11/1971 | Lamb, Jr. | 362/91 |
| 5,795,052 | A | 8/1998 | Choi | |
| 5,870,787 | A * | 2/1999 | Choi | 8/159 |
| 6,295,004 | B1 * | 9/2001 | Burnett | 340/686.1 |
| 2003/0030288 | A1 * | 2/2003 | Miller | A47L 15/4259 292/303 |

FOREIGN PATENT DOCUMENTS

| | | | | |
|---|---|---|---|---|
| BE | EP 1332708 | A2 * | 8/2003 | A47L 15/42 |
| DE | 4220018 | A1 | 12/1993 | |
| DE | 4220018 | C2 | 7/1995 | |
| DE | 4426074 | C1 | 10/1995 | |
| DE | 19649039 | C1 | 4/1998 | |
| WO | 2004049895 | A1 | 6/2004 | |
| WO | 2004051146 | A1 | 6/2004 | |

OTHER PUBLICATIONS

International Search Report PCT/EP/2005/055216.

* cited by examiner

*Primary Examiner* — Nicole Blan
(74) *Attorney, Agent, or Firm* — Michael E. Tschupp; Andre Pallapies

(57) ABSTRACT

An aquiferous domestic appliance has a treatment compartment and articles to be washed disposed therein are illuminated by means of a light source in such a manner that the user is not blinded by the light source and is able to judge the cleaning result even under bad lighting conditions inside the room.

19 Claims, 3 Drawing Sheets

LIGHTING DEVICE FOR A WATER-BEARING DOMESTIC APPLIANCE

CROSS-REFERENCE TO RELATED APPLICATIONS

This application is a continuation, under 35 U.S.C. §120, of U.S. application Ser. No. 11/665,575, filed Apr. 16, 2007 which is a U.S. national stage application under 35 U.S.C. §371 of PCT/EP2005/055216, filed Oct. 13, 2005, which designated the United States; this application also claims the priority, under 35 U.S.C. §119, to German Application No. 10 2004 051 174.8, filed Oct. 20, 2004.

BACKGROUND OF THE INVENTION

The invention relates to a water-bearing domestic appliance for the introduction of articles to be washed, with a treatment compartment which can be sealed with a door having an actuating handle, and with at least one light source assigned to the domestic appliance, which source illuminates the articles to be washed and/or the treatment compartment.

Among water-bearing domestic appliances of the type mentioned a dishwasher is known in which light sources are arranged in the treatment compartment. The light sources serve to illuminate the treatment compartment and articles in the treatment compartment. The disadvantage of this, however, is that the user is dazzled by these light sources. Moreover, optimum illumination of the articles to be washed is not possible when the storage containers for the articles to be washed are pulled out of the treatment compartment where the light conditions in the kitchen are poor. Furthermore, in certain circumstances the light source in the treatment compartment may become contaminated, thus impairing the light intensity.

DE 102 56 168 also discloses a dishwasher in which a light source is arranged in the treatment compartment. The light source is arranged so that even when the door is wide open and the light conditions in the room are poor, the potential risk is low and the user is not able to fall over the door. However, the user is dazzled by the light source arranged in the treatment compartment when unloading the articles to be washed.

BRIEF SUMMARY OF THE INVENTION

The object of the invention is to arrange light sources in water-bearing domestic appliances of the type already described in detail so that the user is not dazzled by the light source and is able to judge the cleaning result even when the light conditions in the room are poor.

This object is achieved according to the invention in that the light source is arranged outside the treatment compartment.

In this arrangement the user is not dazzled by the light source. Furthermore, accessibility for repair work or cleaning is much easier than when the light source is arranged in the treatment compartment.

According to a preferred embodiment provision is made for the light source to be designed as a hot light and/or a cold light. The advantage of this solution is that the cold light is characterised by long service light and a precise angle of departure and the hot light is characterised by its robust design.

According to an advantageous embodiment provision is made for the light source to propagate the light waves as a spot light and/or surface light and/or pointlight. The essential advantage here lies in the fact that in addition to optimum illumination of the articles to be washed in the treatment compartment, optimum illumination of the treatment compartment is also guaranteed.

An essential safety advantage is provided in that the light source is arranged so that it is water-tight. This prevents liquid from penetrating the electrical circuits, resulting in dangerous short-circuiting. Furthermore, premature wear of the light source and reflector by the washing float is avoided.

The installation of the light sources in the door is extremely simple if, according to a further embodiment of the object of the invention, provision is made for the light source to be offset to the front and/or the rear. The light source is protected from undesirable influences, particularly if it is arranged offset to the rear.

In a further advantageous design of the object of the invention provision is made for a switching means that switches off the light source when a minimum pivoting angle of the door and/or a minimum pivoting angle of the actuating handle is exceeded. The advantage of this solution is that the user need not switch off the light source itself when closing or opening the door, and the user is assured, even when closing the door, that the light source is switched off during operation.

According to a closely related preferred embodiment of the invention provision is made for the minimum pivoting angle to be 0° to 10°.

It is particularly advantageous for the light source to be switched off when the door is ajar. The structure of the door is extremely simple when, according to a further preferred embodiment of the invention, provision is made for the switching means to be arranged inside and/or outside the door.

One advantage of this is that the switch inside the door is not visible to the user and the design of the water-bearing domestic appliance remains unchanged. If the switch is arranged outside the door, the production cost of the assembly is reduced.

In order to avoid the user having to switch the light source on and off by means of an additional light switch when opening the door, it is advantageous for the switching means to be arranged in the actuating handle.

According to a closely related advantageous design, provision is made for the switching means to be arranged on the upper and/or lower and/or lateral opening edge. The advantage of this is that the switching means is easily accessible for repair work.

According to a further preferred embodiment, provision is made for the light beams transmitted by the light source to be deflected by at least one optical transmission means. A device equipped according to these features is characterised in that the light beams are guided specifically to the treatment compartment to be illuminated and/or the articles to be washed.

According to a further advantageous design provision is made for the optical transmission means to be an optical projection system, a reflector and/or a diverging lens. The advantage of this solution is that the components are inexpensive to manufacture.

An advantage, from the point of view of production, is achieved if, according to a preferred embodiment of the object of the invention, provision is made for the light source to be connected to control and/or regulating electronics arranged in the door since this reduces the length of the cable from the light source to the control and/or regulating electronics.

According to an alternative design of the object of the invention provision may be made for the light source to be connected to control and/or regulating electronics arranged in the base pan.

This solution provides particular advantages if the light source is arranged on the opening edge, since the cable need not then be guided into the door, thereby reducing the cable length.

According to a further alternative design of the object of the invention provision is made for the light source to be arranged on the upper and/or lateral and/or lower opening edge of the treatment compartment.

This provides the advantage that the plates and dishes are illuminated effectively and the user is able to judge the cleaning result. The door can advantageously be closed by this arrangement without damaging the light source.

According to a further preferred embodiment of the object of the invention, provision is made for the light source to be arranged on the inner door. The particular advantage of this design is that when the door is open, the treatment compartment facing the observer and the article to be washed are illuminated at the front so that the shadows are thrown into the treatment compartment and the article to be washed therefore appears to shine brilliantly, which is aesthetically attractive to the user.

According to a further advantageous design of the object of the invention provision is made for the light source to be arranged in the region of the feed to the water-bearing domestic appliance.

The advantage of this to the user is that when a storage container is pulled out, the articles to be washed can be optimally illuminated from below so that the user is qualitatively able to judge the washing result.

BRIEF DESCRIPTION OF THE DRAWINGS

The invention is explained in the description below with reference to an exemplary embodiment represented in simplified form in the drawings, where.

DETAILED DESCRIPTION OF EXEMPLARY EMBODIMENTS OF THE PRESENT INVENTION

Figure 1:
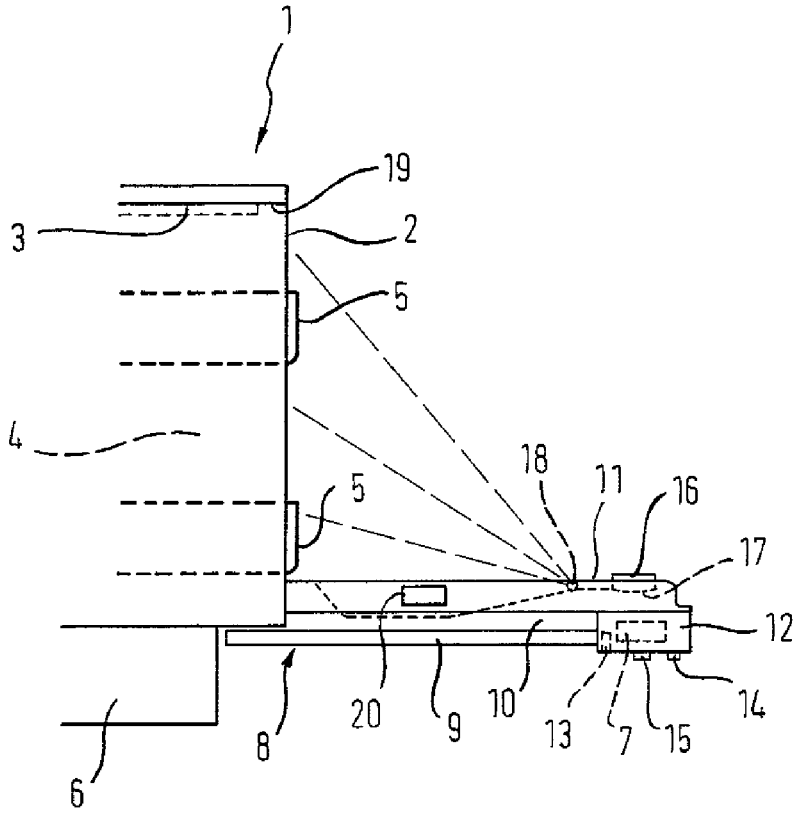
FIG. 1 shows a diagrammatically represented dishwasher according to a first embodiment, with a door mounted about a horizontal pivoting axis, on the inside of which is arranged a light source.
Figure 2:
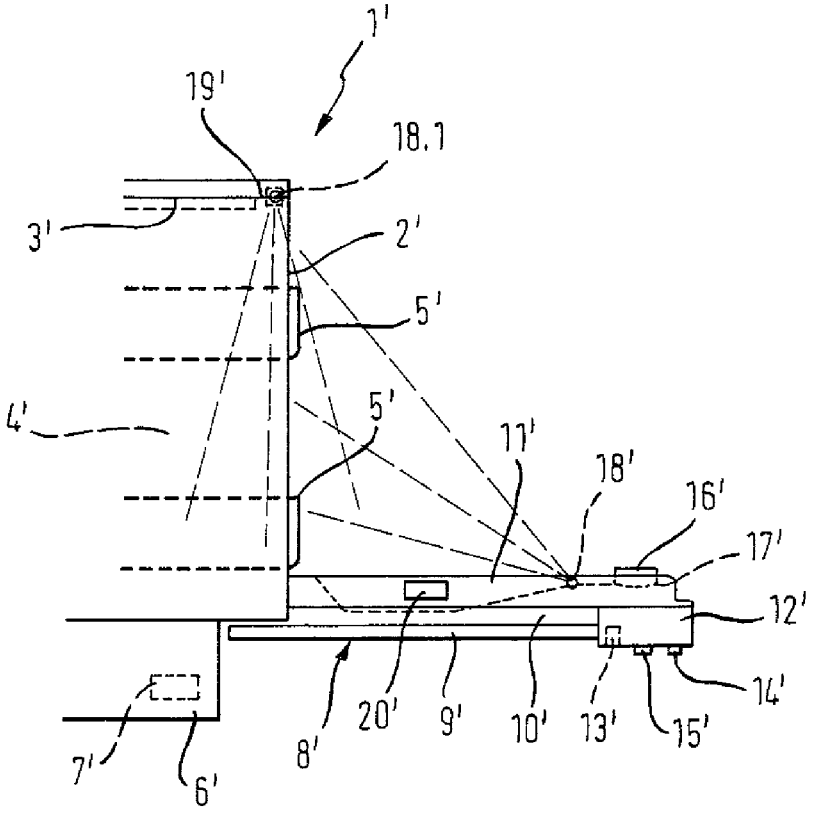
FIG. 2 shows a diagrammatically represented dishwasher according to a second embodiment, with a door mounted about a horizontal pivoting axis, on whose upper opening edge is arranged a light source.

FIGS. 1 and 2 show two dishwashers 1, 1' according to the invention, of essentially similar construction, with a housing 2, 2' which has an inner jacket 3, 3' formed from high grade steel or plastic for lining a treatment compartment 4, 4', which is formed from an inner lining. On its lateral walls the inner lining has guide rails, not shown, on which are retained baskets, designed as storage containers 5, 5', so that they can be pulled out. Storage containers 5, 5' are used to store articles to be washed, not shown, and are wetted by a spray device, not shown. Underneath treatment compartment 4,4' is arranged a base pan 6, 6' which, among other things, is used to house a pump system, not shown, a water softening system, not shown, and control and regulating electronics 7' (FIG. 2) which has a memory device with different washing programs. Treatment compartment 4, 4' is accessible via a door 8, 8' which is mounted pivotably on a horizontal rotating axis, not shown. In this case door 8, 8' has an outer door 10, 10' lined with a furniture support 9, 9', and an inner door 11, 11' connected to it. Assigned to outer door 9, 9' is a door screen 12, 12', which has an actuating handle 13, 13' and a main switch 14, 14' for switching on dishwasher 1, 1', both of which are connected to each other by an electromechanical connection, not shown, inside door screen 12, 12'. Furthermore, at least one program selector switch 15, 15' is arranged on door screen 12, 12', which switch is connected to control and regulating electronics 7 (FIG. 1) arranged inside door screen 12, or to control and regulating electronics 7' (FIG. 2) arranged in base pan 6'. Inner door 11, 11' has a feed 17, 17' which can be sealed with a lid 16, 16', the chambers of which feed are provided for storing a detergent or a rinsing agent.

In both embodiments at least one light source 18, 18' designed as a hot light is arranged offset to the rear on inner door 11, 11' in the vicinity of feed 17, 17', which source may be designed, for example, as an LED and is connected to control and regulating electronics 7, 7' by a cable, not shown. Alternatively light source 18, 18' may also be designed as a cold light and may be arranged offset to the front on inner door 11, 11'.

In the exemplary embodiment shown in FIG. 2 a further light source 18.1 is also proposed, which is fitted on a metal container flange designed as an opening edge 19'. Light source 18.1, like light source 18, 18', is also connected to control and regulating electronics 7'. Opening edge 19, 19' forms an integral part of treatment compartment 4, 4'. Furthermore, an optical transmission means, not shown, which is designed in particular as a reflector, is assigned to light source 18, 18' and light source 18.1. Alternatively the optical transmission means may be designed as a diverging lens or as an optical projection system.

An inclination sensor designed as switching means 20, 20' and connected to control and regulating electronics 7, 7', is arranged laterally inside door 8, 8'. Switching means 20, 20', however, may also be designed alternatively as a pressure switch.

Another alternative possibility is to install switching means 20, 20' outside door 8, 8' so that it is arranged inside actuating handle 13, 13' or on opening edge 19, 19'.

Figure 3:
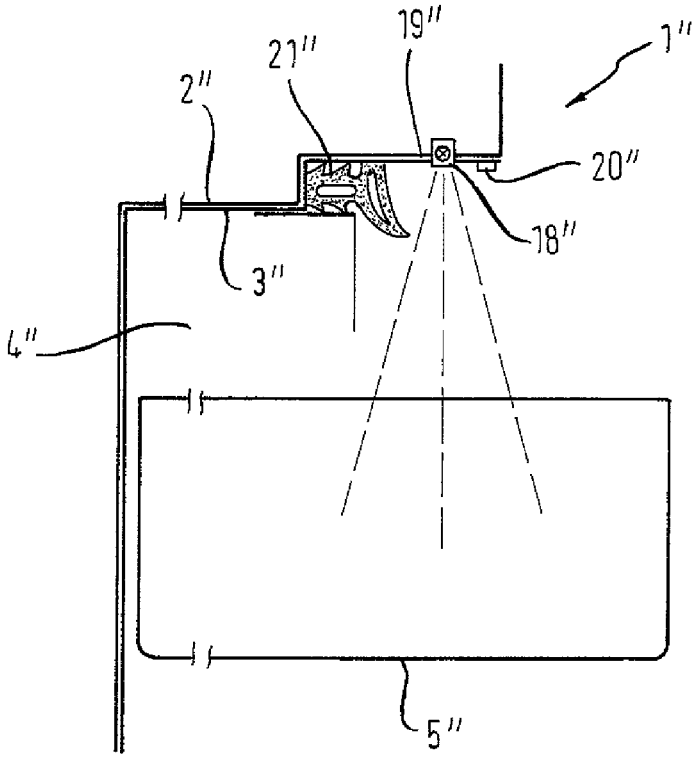
FIG. 3 shows a dishwasher according to the second embodiment, with a treatment compartment represented sectionally in an enlarged form, on the opening edge of which compartment an LED is provided, shown in sectional representation from the side.

FIG. 3 shows an alternative embodiment of a dishwasher 1", represented sectionally in a side view in an enlarged form, with a housing 2", which is equipped with an inner jacket 3", formed from high grade steel, for lining a treatment compartment 4", which may alternatively also be manufactured from plastic. Guide rails, not shown, on which baskets, designed as storage containers 5" for the articles to be washed, not shown, are retained so that they can be pulled out, are arranged on the lateral walls of treatment compartment 4". A container flange, designed as opening edge 19", is also formed on inner jacket 3" on the front of housing 2" of dishwasher 1".

At least one light source 18" is arranged on upper opening edge 19" so that it is offset to the rear. A further alternative possibility is to arrange light source 18" on the lateral or lower opening edge 19". Alternatively light source 18" could also be arranged on all sides of opening edge 19". Light source 18" is connected to control and regulating electronics, not shown, in a base pan, not shown. Furthermore, a pressure switch, designed as switching means 20", is arranged on upper opening edge 19", which pressure switch is also connected to the control and regulating electronics. Furthermore, a plastic seal 21" is assigned to opening edge 19".

During operation the articles to be washed, placed in storage containers 5, 5' by the user, are wetted by the spray device in dishwasher 1, 1'. After control and regulating electronics 7, 7' terminates the program stored in a memory, for example with the program stages "Pre-wash-Clean-Intermediate wash-Rinse-Dry", treatment compartment 4, 4' becomes accessible to the user by opening door 8, 8 by means of actuating handle 13, 13'. Main switch 14, 14' is activated by using actuating handle 13, 13', by means of an electromechanical connection, so that dishwasher 1, 1' is switched off.

During the opening process switching means 20, 20', is activated in door 8, 8' and transmits a signal to control and regulating electronics 7, 7', so that when a minimum pivoting angle of door 8, 8' is exceeded, switching means 20, 20' switches on light source 18, 18'. The minimum pivoting angle is factory set so that then the door inclines with an angle range of 0° to 10°, light source 18, 18' is switched on.

After door 8 has been fully opened by the user (FIG. 1), the light beams are transmitted from light source 18 arranged on door 8 close to feed 17, and are deflected by the optical transmission means so that treatment compartment 4 is illuminated and the articles to be washed, arranged in storage container 5, are also illuminated.

In FIG. 2 a light source 18.1, in addition to light source 18' arranged on door 8' close to feed 17', is arranged on opening edge 19' and illuminates treatment compartment 4' and the articles to be washed arranged in storage container 5'. After storage container 5, 5' is pulled out of treatment compartment 4, 4', storage container 5, 5' is located above light source 18, 18' arranged in door 8, 8' so that the articles to be washed are illuminated from below. In order not to damage light source 18' when opening and closing, light source 18' is advantageously arranged on opening edge 19' offset to the rear (FIG. 2). The user can now easily pull out storage containers 5, 5' fastening to the guide rails, observe the articles to be washed even if the light conditions in the room are poor, and remove them from storage container 5, 5', since they are clearly illuminated by light source 18, 18'. At the same time treatment compartment 4, 4' is illuminated so that repair work can easily be carried, for example, or a lid of the salt container, not shown, in treatment compartment 4, 4' can be opened more easily when topping up the sale due to the improved visual conditions. After the user has emptied storage containers 5, 5' and, if necessary, loaded them with new articles to be washed, door 8, 8' can be re-closed by means of actuating handle 13, 13'. During the closing process the user is able to detect, shortly before the end of the closing process at a minimum pivoting angle ranging from 0° to 10°, that light source 18, 18' is switched off, since treatment compartment 4, 4' is darkened. The user is therefore assured that light source 18, 18' is always switched off during operation. When closed, door 8, 8' is in contact with a door seal, not shown, arranged on opening edge 19, 19', so that no liquid escapes outside from treatment compartment 4, 4'. The user is now able to select the desired program by means of program selector switch 15, 15', which is activated by control and regulating electronics 7, 7' and can be switched on by means of main switch 14, 14' of dishwasher 1, 1'.

The mode of operation of dishwasher 1", shown in FIG. 2, is similar to those of dishwashers 1, 1' shown in FIGS. 1 and 2. The essential difference lies in the fact that light source 18" is located on opening edge 19" only offset to the rear and, when a door, not shown, is open, illuminates treatment compartment 4" and storage container 5" from above. The pressure switch, designed as switching means 20" on upper edge 19", is first deactivated by contact with the door and therefore switches off light source 18".

What is claimed is:

1. An aquiferous domestic appliance for handling articles to be washed, the aquiferous domestic appliance comprising:

an open-sided compartment in which articles to be washed are disposed for an article washing operation, the open-sided compartment having an interior and an access opening adjacent a forward end of the open-sided compartment forming an open side of the open-sided compartment;

an opening edge integral with and forming a part of the open-sided compartment and disposed outside of the access opening;

a door having an actuating handle, the door being movable between a closed position in which the door closes the access opening of the open-sided compartment and an open position in which the door does not close off the access opening of the open-sided compartment, the open-sided compartment and the door in its closed position together forming a wash area in which articles to be washed can be subjected to a washing operation; and a plurality of light sources positioned within the opening edge and within the open-sided compartment and behind a forward edge of the door in the closed position, the plurality of light sources illuminating the interior of the open-sided compartment and articles to be washed that may be disposed in the interior of the open-sided compartment.

2. The aquiferous domestic appliance according to claim 1, wherein the opening edge comprises a metal container flange on which the plurality of light sources are fitted.

3. The aquiferous domestic appliance according to claim 2, wherein the plurality of light sources are positioned rearwardly offset from a forwardmost edge of the metal container flange.

4. The aquiferous domestic appliance according to claim 1, wherein the plurality of light sources are at least one of hot lights and cold lights.

5. The aquiferous domestic appliance according to claim 1, wherein the plurality of light sources are of a type and construction that transmit light waves as at least one of a spotlight, a surface light, and a pointlight.

6. The aquiferous domestic appliance according to claim 1, comprising switching means for switching off a first light source of the plurality of light sources when at least one of a minimum pivoting angle of the door and a minimum pivoting angle of the actuating handle is exceeded.

7. The aquiferous domestic appliance according to claim 6, wherein the minimum pivoting angle is zero degrees)(0°) to ten degrees(10°).

8. The aquiferous domestic appliance according to claim 6, wherein the switching means is arranged outside the door.

9. The aquiferous domestic appliance according to claim 6, wherein the switching means is arranged in the actuating handle.

10. The aquiferous domestic appliance according to claim 6, wherein the switching means is arranged above the door in the closed position of the door.

11. The aquiferous domestic appliance according to claim 1, wherein light beams emitted by the plurality of light sources are deflected by an optical transmission means.

12. The aquiferous domestic appliance according to claim 11, wherein the optical transmission means is at least one of an optical projection system, a reflector and a diverging lens.

13. The aquiferous domestic appliance according to claim 1, wherein the plurality of light sources are connected to control electronics arranged in the door.

14. The aquiferous domestic appliance according to claim 1, wherein the plurality of light sources are connected to control electronics arranged in a base pan of the open-sided compartment.

15. An aquiferous domestic appliance for handling articles to be washed, the aquiferous domestic appliance comprising:

an open-sided compartment in which articles to be washed are disposed for an article washing operation, the open-sided compartment having an interior and an access opening forming an open side of the open-sided compartment;

a door having an actuating handle, sides, a bottom, and a top with an end edge, the door being movable between a closed position in which a forward edge of the door closes the access opening of the open-sided compartment and an open position in which the forward edge of the door does not close off the access opening of the open-sided compartment, the open-sided compartment and the door in its closed position together forming a wash area in which articles to be washed can be subjected to a washing operation;

at least one light source mounted exteriorly of the wash area and within the open-sided compartment for illuminating the wash area and articles to be washed that may be disposed in the interior of the open-sided compartment, the at least one light source being positioned outside of the forward edge of the door;

a seal positioned on the opening edge of and within open-sided compartment, wherein in a closed position, the door engages the seal and the forward edge of the door is offset from the at least one light source; and a pressure switch cooperable with the at least one light source, the pressure switch turning the at least one light source on and off depending on a position of the door, wherein the pressure switch is positioned within the open-sided compartment and forward of the at least one light source such that the at least one light source is disposed between the seal and the pressure switch.

16. The aquiferous domestic appliance according to claim 15, wherein the at least one light source comprises a plurality of light sources mounted exteriorly of the wash area and within the open-sided compartment.

17. An aquiferous domestic appliance comprising:

a housing having a top wall, a bottom wall and two side walls defining an open-sided compartment, where forward ends of the top wall, the bottom wall and the side wall are coplanar;

a treatment compartment disposed in the housing;

a door pivotably mounted relative to the treatment compartment and pivotable between an open position in which the treatment compartment is open and a closed position in which the treatment compartment is sealed closed for a washing operation; and a plurality of light sources, all of which are disposed outside of and above the treatment compartment and within the housing, the plurality of light sources illuminating an interior of the treatment compartment and articles to be washed that may be disposed in the interior of the treatment compartment, wherein the door includes an engaging edge that engages the treatment compartment, and wherein the plurality of light sources are positioned forward of the engaging edge relative to the treatment compartment and the housing.

18. The aquiferous domestic appliance according to claim 17, wherein the door in its closed position together with the treatment compartment form a wash area in which articles to be washed can be subjected to a washing operation, wherein the treatment compartment comprises an opening edge that extends beyond the wash area, and wherein the plurality of light sources are secured to the opening edge.

19. The aquiferous domestic appliance according to claim 17, further comprising a pressure switch cooperable with the plurality of light sources, the pressure switch turning the plurality of light sources on and off depending on a position of the door, wherein the plurality of light sources are disposed between the pressure switch and the treatment compartment.

* * * * *